United States Patent [19]

Frenkel

[11] Patent Number: 4,557,387

[45] Date of Patent: Dec. 10, 1985

[54] MAGNETIC DRUM FOR SEPARATING FERROUS AND NON-FERROUS BEVERAGE CONTAINERS

[75] Inventor: Robert L. Frenkel, Englewood, Colo.

[73] Assignee: Adolph Coors Company, Golden, Colo.

[21] Appl. No.: 605,191

[22] Filed: Apr. 27, 1984

[51] Int. Cl.[4] ..... B07C 5/34; B03C 1/14

[52] U.S. Cl. ..... 209/636; 209/223 A; 209/219; 209/930; 335/306

[58] Field of Search ..... 209/609, 636, 215, 223 A, 209/223 R, 225, 219, 228, 231, 216; 335/302, 306; 198/690; 474/199, 198, 142

[56] References Cited

U.S. PATENT DOCUMENTS

| | | | |
|---|---|---|---|
| 567,381 | 9/1896 | Eickemeyer | 209/219 |
| 1,866,781 | 7/1932 | Ullrich | 209/219 |
| 3,209,912 | 10/1965 | Sloan | 335/306 |
| 4,225,047 | 9/1980 | Grabman | 209/636 |
| 4,463,844 | 8/1984 | Huffman et al. | 194/4 C |

*Primary Examiner*—Frank W. Lutter

*Assistant Examiner*—Wm. Bond

*Attorney, Agent, or Firm*—Klaas & Law

[57] ABSTRACT

A magnetic drum for separating ferrous and non-ferrous beverage containers having a plastic drum which rotates around a series of permanent magnets mounted on a structural support. The plastic drum has an inner cylindrical portion coupled to a power roller which induces rotational movement in the plastic drum. An input chute funnels ferrous and non-ferrous crushed beverage containers onto the outer cylindrical portion of the plastic drum such that crushed ferrous beverage containers are held against the outer cylindrical portion and traverse a predetermined distance around the circumference of the outer cylindrical portion until they are no longer within the influence of the magnetic force field produced by the permanent magnets mounted between the outer cylindrical portion and inner cylindrical portion of the plastic drum. Non-ferrous beverage containers, such as aluminum containers, are not held against the outer cylindrical portion and are, consequently, horizontally displaced and separated from the ferrous beverage containers.

11 Claims, 10 Drawing Figures

MAGNETIC DRUM FOR SEPARATING FERROUS AND NON-FERROUS BEVERAGE CONTAINERS

BACKGROUND OF THE INVENTION

The present invention pertains generally to systems for separating ferrous and non-ferrous materials and more particularly to systems for separating ferrous and non-ferrous beverage containers.

Conventional metal separators for separating ferrous and non-ferrous materials have utilized a horizontally disposed conveyor belt which is driven between a magnetic head pulley and an additional pulley. Power is derived from an electric motor attached to a gear box which couples power to the conveyor belt assembly by way of a drive belt. Ferrous and non-ferrous materials are normally dropped onto the top horizontal portion of the conveyor belt and transported to the magnetic head pulley. Non-ferrous materials drop vertically from the outer horizontal portion of the magnetic head pulley while the ferrous materials traverse around the circumference of the magnetic head pulley on the conveyor belt and are released from the conveyor belt after separation from the magnetic field of the magnetic head pulley. Consequently, ferrous and non-ferrous materials are horizontally separated by a predetermined distance.

The disadvantages and limitations of such conventional separators are that they are generally relatively large and complex devices. The conveyor belt assembly plus the additional gear box motor and drive belt occupy a substantial amount of space. This is clearly a disadvantage for use in devices which are spaced limited. Additionally, the amount of horizontal displacement between ferrous and non-ferrous materials is limited by the size of the magnetic head pulley in such a configuration. Also, the reliability of such systems because of their complexity also limits the operation of these devices. Increased maintenance of individual motors, gear boxes and drive belts, as well as the two pulley system used in the conveyor belt assembly, is prone to break down and high maintenance costs. Also, the continual application of metal pieces to be separated causes excessive wear of the conveyor belt. The requirement of flexibility of the conveyor belt limits its wear resistance properties.

SUMMARY OF THE INVENTION

The present invention overcomes the disadvantages and limitations of the prior art by providing a magnetic drum apparatus for separating ferrous beverage containers from non-ferrous beverage containers comprising: plastic drum means for transporting the non-ferrous beverage containers a first predetermined distance and the ferrous beverage containers a second predetermined distance to separate the non-ferrous beverage containers from the ferrous beverage containers, the plastic drum means comprising: an inner cylindrical portion; an outer cylindrical portion substantially concentrically disposed around and coupled to the inner cylindrical portion; power roller means coupled to the inner cylindrical portion for inducing rotational movement in the plastic drum means to transport the non-ferrous beverage containers on the outer cylindrical portion of the plastic drum means the first predetermined distance; magnetic means disposed between the inner cylindrical portion and the outer cylindrical portion to induce a magnetic field through the outer cylindrical portion sufficient to hold the ferrous beverage containers against the outer cylindrical portion and cause the ferrous beverage containers to follow the rotational movement of the outer cylindrical portion the second predetermined distance to separate the ferrous beverage containers from the non-ferrous beverage containers.

An advantage of the present invention is its compact configuration. The drive motor of the present invention is disposed internally within the plastic drum so that no external gear boxes, motors or drive belts are required. The separation distance provided by the outer cylindrical portion of the plastic drum means is maximized in the present invention for the size of the apparatus to provide maximum horizontal displacement for separation between ferrous and non-ferrous beverage containers. This is the result of the elimination of the conveyor belt and placement of the drive motor within the plastic drum.

Moreover, the present invention is more reliable in operation because of its simplicity in comparison to conventional separators. The present invention uses a single encased power roll which is commercially available and highly reliable in operation. The plastic drum means has a fixed shape, unlike the conveyor belt, such that it can be formed of a high density plastic having high wear resistance. The plastic material has a noise abating quality for engagement of the ferrous and non-ferrous material with the plastic drum. The plastic drum can be easily and inexpensively manufactured and assembled. The power roller means is affixed to the structure by a stationary shaft which does not require any external bearings. Consequently, cost and maintenance of the apparatus of the present invention is greatly reduced over conventional ferrous and non-ferrous separators.

OBJECTS OF THE INVENTION

It is therefore an object of the present invention to provide an improved magnetic drum apparatus for separating ferrous beverage containers from non-ferrous beverage containers.

It is also an object of the present invention to provide a magnetic drum apparatus for separating ferrous beverage containers from non-ferrous beverage containers which is simple and reliable in operation.

Another object of the present invention is to provide a magnetic drum apparatus for separating ferrous beverage containers from non-ferrous beverage containers which is inexpensive to manufacture and maintain.

Additional objects, advantages and novel features of the present invention are set forth in the description which follows and will be understood by those skilled in the art upon the examination of the following or may be learned by practice of the invention. The objects and advantages of the invention may be realized and obtained by means of the instrumentalities and combinations particularly pointed out in the appended claims.

BRIEF DESCRIPTION OF THE DRAWINGS

An illustrative and presently preferred embodiment of the invention is shown in the accompanying drawings, wherein:

FIG. 1 is a side view of the magnetic drum apparatus 10 of the present invention. The magnetic drum apparatus 10 can be utilized to separate ferrous and non-ferrous materials such as beverage containers in devices for dispensing cash for aluminum cans, such as disclosed in U.S. Pat. No. 4,463,884 issued Aug. 7, 1984 to Huffman et al., entitled "Apparatus and Method for Return of Empty Aluminum Cans" which is specifically incorporated herein by reference for all that it discloses.

Figure 1:
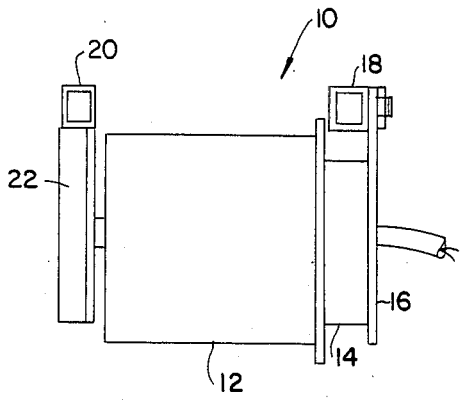
FIG. 1 is a side view of the assembled apparatus of the present invention.

The magnetic drum apparatus 10 comprises plastic drum means 12, structural support means 14, side plate means 16, equipment frame 18, 20, and side plate 22. Plastic drum means 12 rotates around structural support means 14 which is disposed in an annular opening between an inner cylindrical portion and an outer cylindrical portion.

Figure 2:
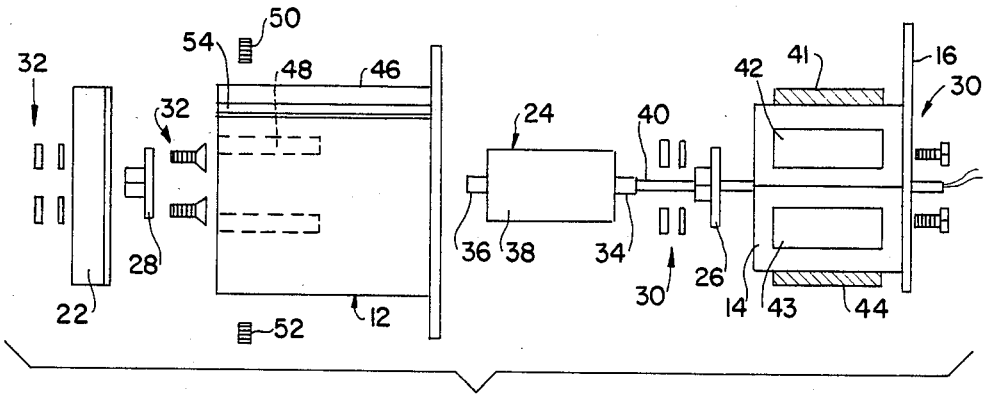
FIG. 2 is an exploded view of the device illustrated in FIG. 1.

FIG. 2 is an exploded view of the magnetic drum apparatus 10, illustrated in FIG. 1. As shown in FIG. 2, a power roller means 24 is disposed in the interior portion of structural support means 14 and is mounted on motor support brackets 26, 28. Suitable power rollers for use with the present invention are the series 6.000 powerroll motorized pulleys available from Interroll Corporation, 60 Hoffman Avenue, Hauppauge, N.Y. 11788. Motor support brackets 26, 28 comprise brackets which are attached to side plates 16, 22, respectively, by way of threaded connectors 30, 32. Motor support brackets 26, 28 have rubber mounting grommets which hold the fixed shaft 34, 36 of power roller 24. Cylindrical portion 38 of power roller 24 rotates around fixed shaft 34, 36 in response to the application of electrical power via electrical cable 40. Permanent magnets 41, 42, 43, 44 are mounted on and bonded to structural support means 14. Structural support means 14 is formed from a mild steel having a permeability sufficient to alter the flux lines of the magnetic field generated by permanent magnets 41, 42, 43, 44 in a manner to produce a magnetic force field sufficient to hold ferrous beverage containers along a predetermined portion of the circumference of the plastic drum means 12 as plastic drum means 12 rotates around structural support means 14. The plastic drum means 12 has an outer cylindrical portion 46 and an inner cylindrical portion 48. Inner cylindrical portion 48 couples directly to the outer surface 38 of power roller 24. Set screws 50, 52 couple inner cylindrical portion 48 to the outer surface 38 of power roller means 24. The inner cylindrical surface of inner cylindrical portion 48 has a taper which matches the taper of the outer surface 38 of power roller means 24. This functions to seat the power roller means 24 in the inner cylindrical portion 48 at the proper axial location. Rib means 54 is disposed on the outer surface of outer cylindrical portion 46 and comprises a raised portion having a generally square cross-sectional configuration.

In operation, power is applied to electrical cable 40 which initiates movement of outer surface portion 38 about fixed shaft 34, 36. Motor support brackets 26, 28 are attached to stationary side plate 16, 22 and hold fixed shaft 34, 36 in a stationary position. Outer surface portion 38 of power roller 24 is coupled to inner cylindrical portion 48 of plastic drum means 12 causing plastic drum means 12 to rotate around the axis of fixed shaft 34, 36. Structural support means 14 and permanent magnets 41, 42, 43, 44 attached thereto are disposed in the cylindrical aperture between inner cylindrical portion 48 and outer cylindrical portion 46. Permanent magnets 41, 42, 43, 44 generate flux fields which penetrate the outer cylindrical portion. Ferrous and non-ferrous beverage containers are dropped onto the surface of plastic drum 12 and are transported by the movement of outer cylindrical portion 46. Magnetic force fields generated by the permanent magnets cause the ferrous beverage containers to be held against the outer cylindrical portion and cause the ferrous beverage containers to follow the rotational movement of the outer cylindrical portion so that they are transported a predetermined distance. Non-ferrous beverage containers fall directly from the outer surface portion by the time they reach a vertical position on outer cylindrical portion 46.

Figure 3:
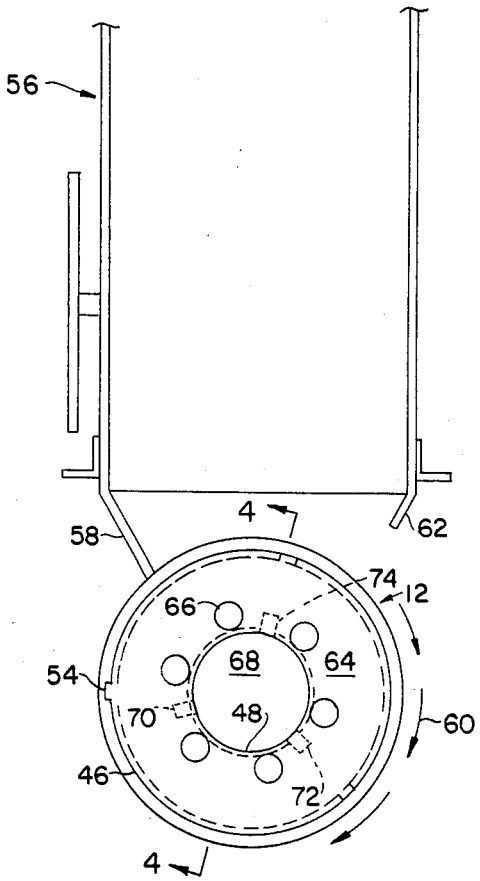
FIG. 3 is an end view of the magnetic drum of the present invention disposed in conjunction with the input chute means.

FIG. 3 is an end view of plastic drum means 12 which is positioned relative to input chute 56. Input chute 56 guides crushed beverage containers which exit the crusher disclosed in the above-identified application onto the outer surface of outer cylindrical means 46. Back deflector 58 prevents the crushed cans from falling in a reversed direction opposite to the movement of plastic drum means 12 as indicated by arrow 60. Front deflector means 62 ensures engagement of the crushed beverage containers with the outer cylindrical portion of the plastic drum means 12. In this manner, the ferrous beverage containers engage and are held against the outer surface of outer cylindrical portion 46. Deflector 58 is positioned to allow clearance of rib portion 54. Rib portion 54 has a height and shape sufficient to disengage ferrous beverage containers from the magnetic field to ensure removal of said ferrous beverage containers from said outer cylindrical portion 46.

FIG. 3 illustrates outer cylindrical portions 46 which is connected to inner cylindrical portion 48 by connector end means 64. Connector end means 64 has a series of airholes 66 formed therein to allow for ventilation of the power roller 24 which is disposed in opening 68. A series of set screw threaded connectors 70, 72, 74 are formed in the inner cylindrical portion 48 to couple the inner cylindrical portion 48 to power roller means 24.

Figure 4:
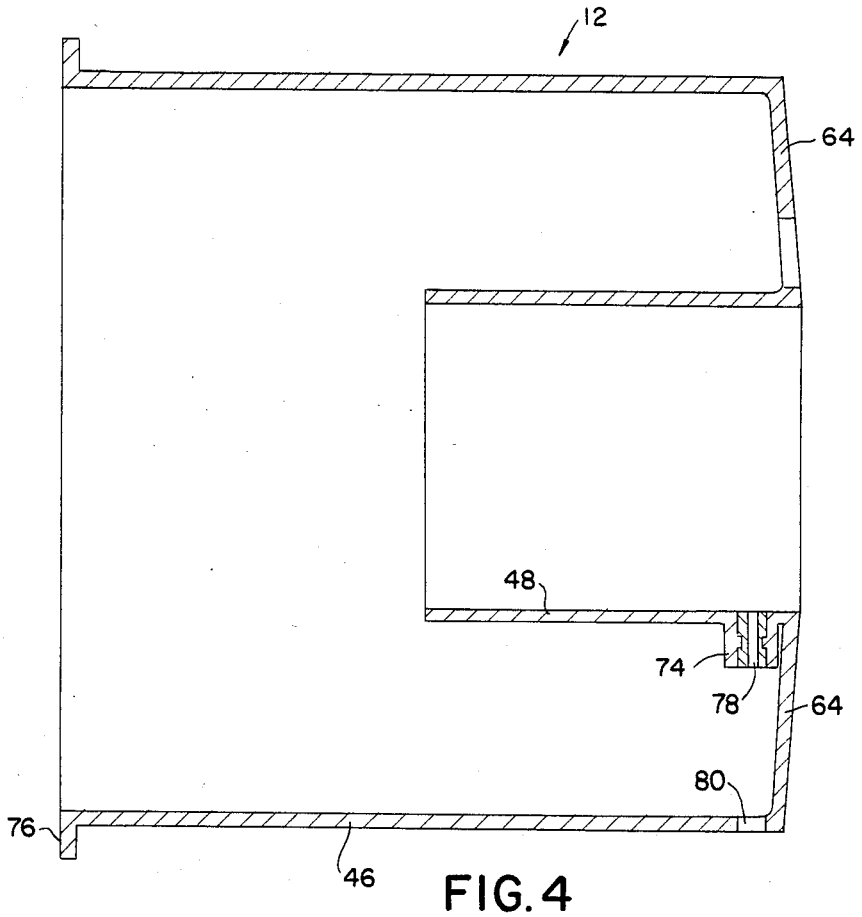
FIG. 4 is a sectional of the magnetic drum means illustrated in FIG. 3.

FIG. 4 is a sectional view of plastic drum means 12 illustrated in FIG. 3. As illustrated in FIG. 4, outer cylindrical portion 46 is connected to inner cylindrical portion 48 by way of connector end means 64. Although each of these portions of drum means 12 has been separately delineated, plastic drum means 12 is formed as a single unitary structure from a single piece of material. Flange portion 76 contains the ferrous and non-ferrous beverage containers on the outer cylindrical portion 46. Set screw device 74 has an opening 78 in which a set screw is disposed to engage power roller 24. Opening 80 in outer cylindrical portion 46 provide access to the set screw disposed in opening 78. Plastic drum means 12 is roto-molded from a polyethylene material having sufficient density to have high wear resistance characteristics. Interaction between ferrous and non-ferrous metal beverage containers and the outer cylindrical portion 46 causes very little wear of outer cylindrical portion 46 due to the high density of the plastic material utilized. Additionally, the plastic/-metal interaction is noise-abated due to the noise-abatement characteristics of the plastic.

Figure 5:
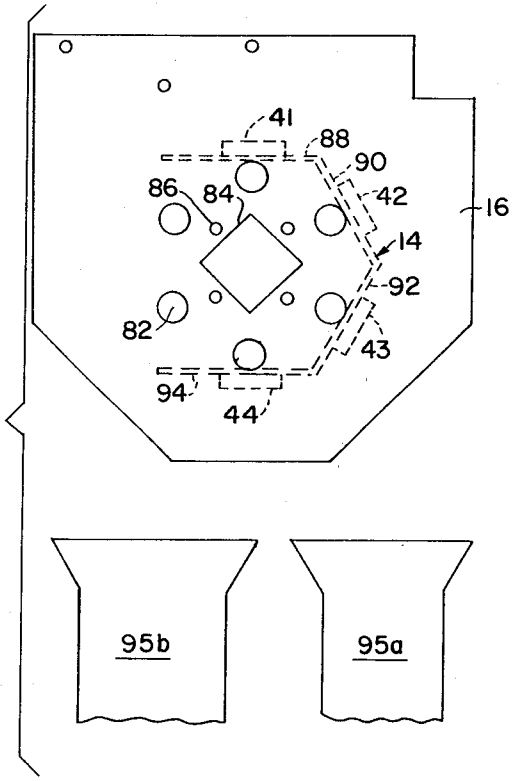
FIG. 5 is an end view of one side plate of the present invention.

FIG. 5 is an end view of end plate 16 viewed from the right side of FIG. 2. As shown in FIG. 5, structural support means 14 is attached to end plate 16 by welding or brazing. End plate 16 may have a series of air circulation holes 82 formed around the interior portion of structural support means 14. A square opening 84 is formed in end plate 16 for attachment of motor support bracket 26 (FIG. 1). Bolt holes 86 function to couple motor support bracket 26 to end plate 16 by way of threaded connectors 30 (FIG. 1). Structural support means 14 has an angular shape with flat surfaces 88, 90, 92, 94 on which magnets 41, 42, 43, 44 are bonded by gluing or other suitable bonding means. The location of the magnets 41, 42, 43, 44 produces a magnetic force field which penetrates the outer cylindrical portion 46 of plastic drum means 12 to cause the ferrous beverage containers to be held to the outer cylindrical portion 46 for a predetermined distance as the plastic drum rotates around the structural support means 14. A chute **95*a* for receiving non-ferrous beverage containers and a chute 95*b* for receiving ferrous beverage containers are located beneath the magnetic drum apparatus as illustrated in FIG. 5**.

Figure 6:
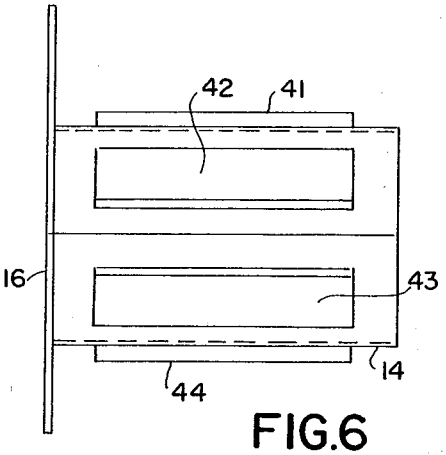
FIG. 6 is a side view of the side plate illustrated in FIG. 5 and the support structure means detached thereto.

FIG. 6 is a side view of structural support means 14 and end plate 16. FIG. 6 illustrates the manner of attachment of structural support means 14 to side plate 16.

Figure 7:
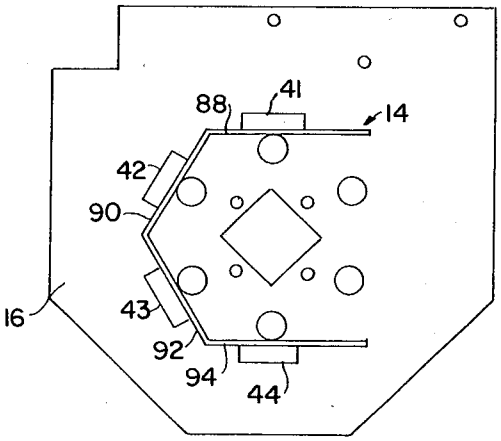
FIG. 7 is an opposite end view of the support structure means and side plate illustrated in FIGS. 5 and 6.

FIG. 7 is an opposite end view of structural support means 14 and side plate 16 from that illustrated in FIG. 5. FIG. 7 illustrates each of the surfaces 88, 90, 92, 94 on which magnets 41, 42, 43, 44 are bonded.

Figure 8:
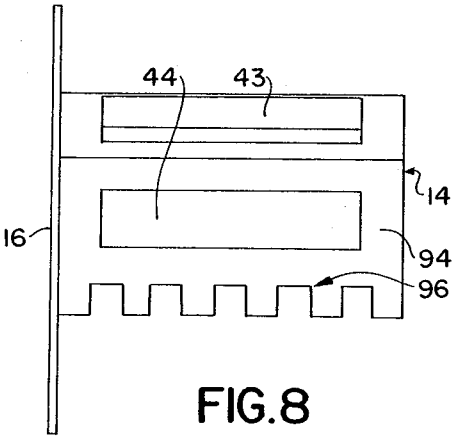
FIG. 8 is a bottom side view of the support structure and side plate illustrated in FIGS. 5 through 7.

FIG. 8 is an upward side view of structural support means 14 and side plate 15. Notched portions 96 are formed in surface 94 which functions to deplete the magnetic flux field generated by magnet 44 bonded to surface 94. This causes a gradual diminishing of the magnetic force field for release of the cans after they have travelled a predetermined distance around the circumference of the outer cylindrical portion 46 of the plastic drum means 12.

Figure 9:
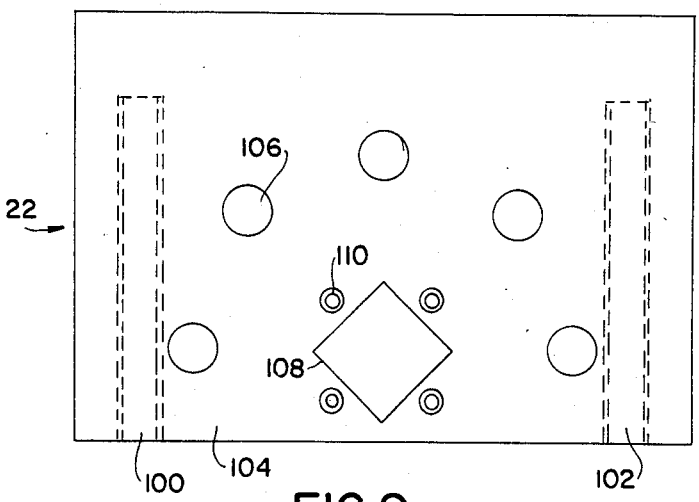
FIG. 9 is an end view of an additional side plate of the present invention.

FIG. 9 is an end view of side plate 22. Side plate 22 has two support brackets 100, 102 which are welded to plate 104. Plate 104 may have five airholes 106 formed therein for the purpose of air circulation and cooling. Square opening 108 provides an opening for mounting of motor support bracket 28 (FIG. 2). Motor support bracket 28 has a series of four bolt holes 110 for mounting using threaded connectors 32 (FIG. 1).

Figure 10:
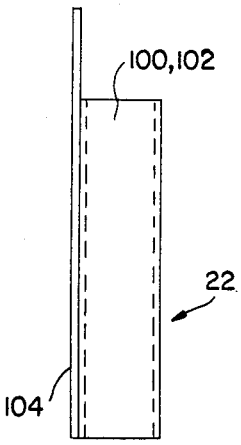
FIG. 10 is a side view of the side plate illustrated in FIG. 9. cl DETAILED DESCRIPTION

FIG. 10 is a side view of side plate 22 illustrating support brackets 100, 102 and plate 104. Brackets 100, 102 extend only partially along plate 104 to allow a portion of plate 104 for attachment to the equipment frame.

Consequently the present invention provides a device which has a compact configuration having a drive motor which is disposed internally within a plastic drum so that no external gearboxes, motors or drive belts are required. The separation distance provided by the plastic drum means is maximized for the size limitations of the apparatus. This is the result of the elimination of the conveyor belt and placement of the drive motor within the plastic drum. Moreover, the present invention is more reliable in operation because of its simplicity compared to conventional separators. The present invention utilizes commercially available power rollers which are highly reliable in operation. The plastic drum means has a fixed shape so that it can be formed of high density plastic having high wear resistance. Additionally, the plastic material used has a noise-abating quality which limits the production of noise during the engagement of the ferrous and non-ferrous materials with the plastic drum. Also, the plastic drum can be easily and inexpensively manufactured. The design of the magnetic drum apparatus allows for easy assembly. Consequently, cost and maintenance of the magnetic drum apparatus of the present invention is greatly reduced over conventional ferrous and non-ferrous separators.

The foregoing description of the invention has been presented for purposes of illustration and description. It is not intended to be exhaustive or to limit the invention to the precise form disclosed, and other modifications and variations may be possible in light of above teachings. The embodiment was chosen and described in order to best explain the principles of the invention and its practical application to thereby enable other skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A magnetic drum apparatus for separating ferrous beverage containers from non-ferrous beverage containers comprising:

plastic drum means for transporting said non-ferrous beverage containers a first predetermined distance and said ferrous beverage containers a second additional predetermined distance to separate said non-ferrous beverage containers from said ferrous beverage containers, said plastic drum means comprising:

a hollow inner generally cylindrical portion having inner and outer surfaces:

a hollow outer generally cylindrical portion having inner and outer surfaces with at least a portion of said outer cylindrical portion being concentrically disposed around said inner cylindrical portion and means for coupling said inner cylindrical portion to said outer cylindrical portion for movement therewith;

means for depositing ferrous and non-ferrous beverage containers onto said outer surface of said outer cylindrical portion;

power roller means coupled to said inner cylindrical portion for inducing rotational movement in said plastic drum means to transport said non-ferrous beverage containers on said outer surface of said outer cylindrical portion of said plastic drum means said first predetermined distance;

said power roller means having an outer surface in contact with said inner surface of said inner cylindrical portion;

the longitudinal axis of said outer surface of said power roller means being coextensive with the longitudinal axis of said inner cylindrical portion; and magnetic means disposed between said outer surface of said inner cylindrical portion and said inner surface of said outer cylindrical portion to induce a magnetic field through said outer cylindrical portion for a segment of its arc of rotation sufficient to hold said ferrous beverage containers against said outer surface of said outer cylindrical portion and cause said ferrous beverage containers to follow said rotational movement of said outer cylindrical portion said second additional predetermined distance to separate said ferrous beverage containers from said non-ferrous beverage containers.

2. The magnetic drum apparatus of claim 1 further comprising:

structural support means for holding said magnetic means in a stationary position adjacent to said inner surface of said outer cylindrical portion along a predetermined portion of the circumference of said plastic drum means.

3. The magnetic drum apparatus of claim 2 wherein said structural support means comprises a metal structural support for holding said magnetic means and altering magnetic flux lines generated by said magnetic field to hold said ferrous beverage containers on said outer surface of said outer cylindrical portion for said second predetermined distance.

4. The magnetic drum apparatus of claim 3 wherein said structural support means has spaced apart end portions which extend in a longitudinal direction and are notched to gradually diminish said magnetic flux lines.

5. The magnetic drum means of claim 2 wherein said means for coupling said inner cylindrical portion to said outer cylindrical portion for movement therewith comprises:

an annular wall extending between and integral with concentric end portions of said outer cylindrical portion and said inner cylindrical portion;

said outer cylindrical portion having an axial extent greater than the axial extent of said inner cylindrical portion so as to form an annular cavity therebetween; and said structural support means extending into said annular cavity so at least a portion of said magnetic means is located in said annular cavity.

6. The apparatus of claim 5 wherein said outer surface of said power roller means is tapered and said inner surface of said inner cylindrical portion is correspondingly tapered so as to seat said power roller means on said inner cylindrical portion in a predetermined location.

7. The apparatus of claim 6 further comprising:

set screw means for coupling said power roller means to said inner cylindrical portion.

8. The magnetic drum apparatus of claim 1 further comprising:

chute means for guiding said ferrous and non-ferrous beverage containers onto said plastic drum means, said chute means having a back deflector for preventing said ferrous and non-ferrous beverage containers from moving in a direction opposite to the direction of said rotational movement of said outer cylindrical portion and front deflector means for ensuring engagement of said ferrous and non-ferrous beverage containers with said outer cylindrical portion;

the end of said back deflector being spaced from said outer surface of said outer cylindrical portion a distance less than the thickness of any ferrous or non-ferrous beverage container;

rib means formed on said outer cylindrical portion and having a predetermined height less than said space between said back deflector and said outer surface of said outer cylindrical portion but sufficient to disengage any ferrous beverage container located between said back deflector and said outer surface of said outer cylindrical portion.

9. The apparatus of claim 8 further comprising:

ferrous beverage container chute means disposed adjacent said plastic drum means in a position to accept ferrous beverage containers released by said plastic drum means;

non-ferrous beverage container chute means disposed adjacent said plastic drum means in a position to accept said non-ferrous beverage containers released by said plastic drum means.

10. The magnetic drum apparatus of claim 1 wherein said magnetic means comprise permanent magnets.

11. The apparatus of claim 10 wherein said permanent magnets are bonded to said structural support means at predetermined locations to set the length of said second predetermined distance.

* * * * *